US006211101B1

(12) United States Patent
Tsutsui et al.

(10) Patent No.: US 6,211,101 B1
(45) Date of Patent: Apr. 3, 2001

(54) DURABLE HYDROPHILIC FIBER AND FABRIC USING THE SAME

(75) Inventors: Toshihiko Tsutsui, Moriyama; Masayasu Suzuki, Shiga-ken; Masahito Katsuya, Moriyama, all of (JP)

(73) Assignee: Chisso Corporation, Osaka (JP)

( * ) Notice: Subject to any disclaimer, the term of this patent is extended or adjusted under 35 U.S.C. 154(b) by 0 days.

(21) Appl. No.: 09/350,129

(22) Filed: Jul. 9, 1999

(30) Foreign Application Priority Data

Jul. 10, 1998 (JP) ..... 10-211855

(51) Int. Cl.[7] ..... B32B 27/04; B32B 27/12; B32B 5/02

(52) U.S. Cl. ..... 442/118; 442/301; 442/414; 428/378

(58) Field of Search ..... 442/118, 414, 442/301; 428/375, 378

(56) References Cited

U.S. PATENT DOCUMENTS

| | | | | |
|---|---|---|---|---|
| 4,789,588 | | 12/1988 | Suzuki et al. . | |
| 4,792,481 | * | 12/1988 | O'Connor et al. | 428/288 |
| 4,921,622 | | 5/1990 | Kato et al. . | |
| 4,988,449 | | 1/1991 | Kato et al. . | |
| 5,045,387 | * | 9/1991 | Schmalz | 428/284 |
| 5,087,520 | | 2/1992 | Suzuki et al. . | |
| 5,258,129 | | 11/1993 | Kato et al. . | |
| 5,654,086 | | 8/1997 | Nishijima et al. . | |
| 6,028,016 | * | 2/2000 | Yahiaoui et al. | 442/118 |

FOREIGN PATENT DOCUMENTS

| | | |
|---|---|---|
| 63-6166 | 1/1988 | (JP) . |
| 63-49158 | 3/1988 | (JP) . |
| 63-303184 | 12/1988 | (JP) . |
| 1-148879 | 6/1989 | (JP) . |
| 1-148880 | 6/1989 | (JP) . |
| 2-169774 | 6/1990 | (JP) . |
| 3-59169 | 3/1991 | (JP) . |
| 3-50030 | 7/1991 | (JP) . |
| 9-49166 | 2/1997 | (JP) . |

* cited by examiner

*Primary Examiner*—Blaine Copenheaver
*Assistant Examiner*—Norca L. Torres
(74) *Attorney, Agent, or Firm*—McDermott, Will & Emery

(57) ABSTRACT

The present invention provides a durable hydrophilic fiber and fabric using said fiber having superior durable hydrophilicity being able to utilize preferably in the medical or hygienic material sections. The durable hydrophilic fiber of the invention can be obtained by applying 0.2 to 1.5% by weight of a fiber treating agent to a thermoplastic fiber based on the thermoplastic fiber. The fiber treating agent contains at least 40% by weight of a mixture comprising 80 to 20% by weight of (A) betaine ampho-ionic surface active agent and 20 to 80% by weight of (B) di-carboxylic acid ester compound from polyalkylene adduct of hydroxy-fatty acid ester.

8 Claims, No Drawings

DURABLE HYDROPHILIC FIBER AND FABRIC USING THE SAME

BACKGROUND OF THE INVENTION

1. Field of the Invention

This invention relates to a durable hydrophilic fiber. More specifically, this invention relates to a durable hydrophilic fiber and a fabric obtainable by using the fiber, useful mainly as a surface layer or a second sheet of the hygienic materials such as disposable diaper or sanitary napkin, as a shape preserver for water absorbing products, or further as industrial and medical wiping cloths.

2. Description of the Related Art

Hygienic articles such as a disposable diaper are formed of three layers of a surface material, an absorbing material and a backing material in the order from the side contacting directly to the skin. The surface material is required to possess good water permeability for rapid transmission of liquid to be absorbed to the absorbing material and also good dry touch which prevents absorbed liquid to flow back and provides skin dry feeling. It is preferable to be hydrophilic to improve water permeability. However, on the other hand, it is preferable to be hydrophobic to improve dry touch.

To achieve this paradoxical purpose, a non-woven fabrics made of polyolefin or polyester type fiber to which small amount of surface active agent is applied to afford desired hydrophilicity. (JP-A-63-6166; JP-A-63-49158)

However such surface materials using fiber to which surface active agent is applied have a drawback that, after once or twice liquid absorption, water permeability decreases rapidly caused by efflux of surface active agent resulting in unpleasant feeling due to remaining of liquid on the surface material.

Also known is a non-woven fabric made of durable hydrophilic fiber to which a surface active agent containing a water-soluble modified silicone is applied thus reducing the efflux of applied surface active agent and keeping hydrophilicity after repeated water transmission (JP-A-63-303184; JP-A-1-148879; JP-A-1-148880; JP-A-2-169774; JP-A-3-59169). However, such non-woven fabrics or knit/woven textiles consisting of durable hydrophilic fiber with these surface active agents, though showing comparatively good durable hydrophilicity, due to the water-soluble modified silicone contained as the necessary component, had a problem of poor strength of web or non-woven laminates caused by reduced friction between fibers. Further it was a problem that, in the stage of winding non-woven product, wound-up shape is unstable due to over flatness between non-woven webs.

According to JP-B-3-50030, it is proposed that hydrophilic polyolefin fiber can be achieved by applying the mixture of surface active agents such as alkylene oxide adduct to the compound having alkylolamide and active hydrogen or alkyl phosphate and so on. However this process cannot give enough durable hydrophilicity and anti-electrostaticity.

SUMMARY OF THE INVENTION

The object of this invention is to provide a durable hydrophilic fiber and a fabric using such fiber having durable hydrophilicity overcoming problems existing in the prior art above-mentioned, also having low slip between fibers not to reduce the strength of fibrous laminate such as non-woven fabrics.

The present inventors tried hard to solve above-mentioned problems and came to the conclusion that applying a mixture of specific surface active agents as the fiber finisher (fiber treating agent) can solve the problems and completed this invention.

To solve the above-mentioned problems, this invention features as the following:

1. A durable hydrophilic fiber comprising a fiber consisting of a thermoplastic resin to which 0.2–1.5% by weight of fiber-treating agent based on the fiber is applied wherein the fiber-treating agent contains at least 40% by weight of a mixture consisting of 20–80% by weight of the following component (A) and 80–20% by weight of the following component (B), wherein component (A) is a betaine compound represented by formula (1)

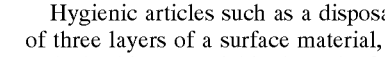

$$R^1R^2R^3—N^+—CH_2COO^- \quad (1)$$

($R^1$ represents an alkyl group having 8–30 carbon atoms or such an alkyl group wherein its hydrogen atom is replaced by a hydroxyl- or a carboxyl-group; $R^2$ and $R^3$ each represents independently a hydrogen, an alkyl group having 1–5 carbon atoms or such an alkyl group wherein its hydrogen atom is replaced by a hydroxyl- or a carboxyl-group.), and component (B) is an ester compound of a dicarboxylic acid having 2–20 carbon atoms, and an ester of hydroxy-fatty acid having 5–30 carbon atoms which 10 to 100 mol % (on the basis of the number of hydroxyl groups existing in the molecule of said hydroxy-fatty acid ester) of oxyalkylene units are added to its hydroxyl group.

2. The durable hydrophilic fiber according to the above clause 1, wherein the fiber-treating agent contains at least 80% by weight of mixture consisting of 20 to 50% by weight of said component (A), 20 to 50% by weight of said component (B) and, additionally 20 to 60% by weight of an anionic surface active agent (C).

3. The durable hydrophilic fiber according to the above clause 1 or 2, wherein said component (A) is an alkyl dimethylbetaine compound in which $R^1$ is an alkyl group having 8–20 carbon atoms, and $R^2$ and $R^3$ are both methyl group.

4. The durable hydrophilic fiber according to the above clause 1 or 2, wherein the "ester of hydroxy-fatty acid" having 5–30 carbon atoms which 10 to 100 mol % (on the basis of the number of hydroxyl groups existing in the molecule of said hydroxy-fatty acid ester) of polyoxyalkylene units are added to its hydroxyl group in the component (B) is a hardened castor oil polyoxyethylene adduct.

5. The durable hydrophilic fiber according to any of the above clause 1–4, wherein the component (B) is a maleic acid ester of a hardened castor oil polyoxyethylene addict.

6. The durable hydrophilic fiber according to any of the above clause 1–5, wherein at least one component of the thermoplastic resin is polyolefin resin.

7. The durable hydrophilic fiber according to any of the above clause 1–5, wherein at least one component of the thermoplastic resin is polyester resin.

8. A fabric made of the fiber described in any of the above clause 1–7.

DETAILED DESCRIPTION OF THE PREFERRED EMBODIMENTS

The invention is described in detail as the following. As fibers usable in this invention, thermoplastic fibers from thermoplastic resins such as polyolefin resin, polyester resin or polyamide resin can be illustrated. Among them, hydrophobic polyolefin or polyester thermoplastic fibers are preferable for application to hygienic materials especially surface material or second sheet because of dry touch. Polyolefin resin include homopolymers of ethylene or propylene, or crystalline coplymers with other α-olefin, or mixtures of these, α-olefin coplymers include two or three monomers copolymer in which propylene is dominating. Examples of such copolymers are butene-1 or 4-methylpentene-1 with dominating propylene. Polyester resins are illustrated by polyethylene tereplithalate, polybutylene terephthalate, and copolyesters such as poly (ethyleneterephthalate-coethyleneisoplithalate), and copolyetherester. Depending application, a mixture of polyester resin, polyamide resin (Nylon 6, Nylon 66 etc.) or polyolefin resin can be successfully used under appropriate selection.

When the durable hydrophilic fibers of this invention are conjugate fibers consisting of two or more resins, several complex formations can be illustrated such as sheath-core, parallel, eccentric sheath-core, multi-layer, radial or island-sea formations.

Concerning the combination of resin in the conjugate fibers, polyolefin/polyolefin such as HDPE/PP, LLDPE/PP, LDPE/PP, "bipolymer" or "terpolymer" of propylene and other "α-olefin(s)"/PP, LLDPE/HDPE, LDPE/HDPE and so on; or polyolefin/polyester such as PP/PET, HDPE/PET, LLDPE/PET,LDPE/PET and so on; or polyester/polyester such as copolyester/PET are illustrated. Further fibers from polyamide/polyester or polyolefin/polyamide can be illustrated. (As the codes used in the above description, HDPE means high density polyethylene, LLDPE means linear low density polyethylene, LDPE means low density polyethylene, PP means polypropylene, and PET means polyethylene teleplithalate.)

Although single fiber denier of the durable hydrophilic fiber is not specifically limited, when used for hygienic materials which requires excellent softness, 20 denier or less, preferably 10 denier or less, and more preferably 8 denier or less would be feasible.

The cross-sectional form of the durable hydrophilic fiber of this invention can be circular or non-circular shape. In the case of the non-circular shape, for example, oval-shape, polygonal such as triangle to octagonal, T-shape, hollowed section polyfoliate or any other free shapes could be adopted. "Polyfoliate" shape means a fiber which has grooves set optionally on the surface of the fiber.

The durable hydrophilic fiber having such cross-sectional form and its fabric of this invention provides broader fiber surface so that more fiber-treating agent can be held on fiber and liquid diffusivity is also provided.

The durable hydrophilic fiber of this invention can include stabilizers, flame retardants or pigments which are normally used for conventional fibers to the extent not to be harmful to the effects of this invention.

Followings are explanation of a mixture comprising components (A) and (B) used in this invention (hereafter noted as "treating agent" or "finishing agent").

The component (A) used in this invention is a betaine ampho-ionic surface-active agent which has both cationic quarterly ammonium salt type cationic part and carboxylic acid salt type anionic part within the molecule represented as formula (1):

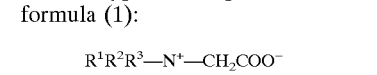

$$R^1R^2R^3—N^+—CH_2COO^- \quad (1)$$

where $R^1$ represents alkyl group having 8–30 carbon atoms or such alkyl group in which hydrogen(s) is substituted by hydroxyl- or carboxyl-group(s); $R^2$ and $R^3$ each independently hydrogen atom, alkyl group having 1–5 carbon atoms or such alkyl group in which hydrogen is substituted by hydroxyl- or carboxyl group.

$R^1$ linked to quaternary ammonium salt is preferably an alkyl group having 8–30 carbon atoms and more preferably 12–18 carbon atoms. When having carbon atoms less than 8, durable hydrophilicity lowers because molecular weight of hydrophobic part decreases. And when having carbon atoms exceeding 30, it is uneconomical due to high cost. Further, hydrogen atom(s) on the alkyl $R^1$ can be optionally substituted by hydroxyl-, carboxyl or other functional group. (It is possible to use any functional group other than hydroxyl- or carboxyl group when such substitution realized to cause same effect as disclosed in this invention.)

Also $R^2$ and $R^3$ linked to quaternary ammonium salt each represents independently an alkyl group having 1–5 carbon atoms or such alkyl group in which hydrogen is substituted by hydroxyl- or carboxyl group although $R^2$ and $R^3$ are most preferably alkyl group having 1–5 carbon atoms.

When having carbon atoms exceeding 5, it is unpractical because of cost. Or $R^2$ and $R^3$ can be hydrogen atom but less stable compared to alkyl group having 1–5 carbon atoms.

Further hydrogen atom of alkyl group in $R^2$ and $R^3$ can be optionally substituted by hydroxyl-, carboxyl or other functional group. (It is possible to use any functional group other than hydroxyl- or carboxyl group when such substitution realized to cause same effect as disclosed in this invention.)

The component (B) used in this invention is a surface-active agent and more specifically an ester compound of a dicarboxylie acid having 2–20 carbon atoms and an ester of hydroxy-fatty acid having 5–30 carbon atoms which 10 to 100 mol % (on the basis of the number of hydroxyl groups existing in the molecule of said hydroxy-fatty acid ester) of oxyalkylene units are added to its hydroxyl group.

The hydroxy-fatty acid means a fatty acid having hydroxyl group(s) in its molecule. The number of carbon atoms in the hydroxy-fatty acid can be illustrated for 5 to 30. For example, propenyl glycolic acid, parasorbic acid, ricinolic acid or 16-hydroxy-7-hexadecenic acid can be illustrated as an unsaturated hydroxy-fatty acid. 2-hydroxypalmitic acid or hydroxy-stearic acid can be illustrated as a saturated hydroxy-fatty acid. Unsaturated hydroxy-fatty acid can be converted to saturated hydroxy-fatty acid by hydrogen nation.

The above illustrated are all mono-hydroxy-fatty acid but polyhydroxy-fatty acid containing more than two hydroxyl groups within the molecule such as dihydroxy-stearic acid or trihydroxy-palmitic acid can also be used.

As for such alcohol for making these hydroxy-fatty acid ester, illustrative are mono-hydroxyl aliphatic alcohols such as methanol, ethanol, butanol, 2-ethyl hexanol, lauryl alcohol or benzyl alcohol; di- to hexa-hydroxyl aliphatic alcohols such as ethylene glycol, propylene glycol, butane diol, hexane diol, glycerine, tri-methylol propane, sorbitol, pentaerythritol and so on.

Among them, more preferable are di- to tetra-hydroxyl aliphatic alcohol such as ethylene glycol, glycerine or pentaerythritol.

Polyhydroxyl alcohol can be partially esterized with same or different aliphatic carboxylic acid. Thus various hydroxy fatty acid esters can be preferably used.

However, from the viewpoint of cost and availability, most preferable are hardened (hydrogenated) castor oil, ricinoleic acid glyceride obtained from the extraction of castor oil as the main product and its hydrogenation product of 12-hydroxy stearic acid glyceride.

In this invention, said oxyalkylene units to form polyether block to be added to hydroxyl group of said hydroxy fatty acid ester are those having 2 to 4 carbon atoms such as oxyethylene, oxypropylene or oxybutylene. Repeating number of said oxyalkylene units are 10 to 100 mol %, more preferably 20 to 80 mol %, on the basis of the number of hydroxyl group existing in said hydroxy fatty acid ester.

Such polyether block can be consisted of oxyethylene units only or can include other oxyalkylene units block-wise and/or random-wise.

In this invention, said di-carboxylic acid to be reacted with hydroxy fatty acid ester is a di-carboxylic acid selected from the group of aliphatic di-carboxylic acid, aliphatic unsaturated di-carboxylic acid and aromatic di-carboxylic acid.

This di-carboxylic acid can be single compound or different di-carboxylic acid mixture. An acid unhydride derived from said di-carboxylic acid can also be used. Examples of the aliphatic di-carboxylic acid are maleic acid, fumaric acid, succinic acid, adipic acid and so on.

In case of aliphatic di-carboxylic acid, the number of carbon is not limited but those having 2 to 20 carbon atoms can be used and, more preferably 4 to 10, e.g. maleic acid, maleic acid unhydride or fumaric acid. Those having carbon atoms exceeding 20 are not practical due to high cost.

In this invention, fiber-treating agent having superior durable hydrophilicity is required anti-staticity besides durable hydrophilicity in case of using for hygienic application, and required easy passage on the carding machine namely smoothness in case of using for staple fibers. So it is desirable to add an anionic surface active agent (C) having both anti-staticity and smoothness.

Said anionic surface active agent can be any one from carboxylic acid salt, sulfonic acid salt, sulfuric acid ester salt, phosphoric acid salt etc. More specifically, soaps such as potassium oleate, sodium laurate etc. as for carboxylic acid salt; alkyl-sulfonic acid salts such as sodium lauryl sulsonate and sodium cetyl sulfonate, or alkyl-benzene sulfonic acid salts such as lauryl benzene sulfonic acid salt as for sulfonic acid salt; alkyl-sulfuric acid ester salts such as sodium stearyl sulfate ester salt, or alkyl (polyoxyalkylene) sulfuric acid ester salts such as sodium oxyalkylene adducts to lauryl alcohol; phosphoric acid ester salts such as those in which higher alcohol such as stearyl alcohol (or its polyoxyalkylene adducts) is reacted with phosphoric acid to give ester. Among them, alkali metal ester sulfate or alkali metal ester phosphate having higher alcohol or its polyoxyalkylene adduct shows excellent anti-staticity. Especially alkali-metal salt of phosphoric ester is preferable because it provides excellent smoothness also.

The number of carbon of higher alcohol in this alkali metal salt of phosphoric ester can be 10 to 22, more preferably 10 to 18 which includes completely neutralized mono- or di-ester of decyl alcohol, lauryl alcohol, myristyl alcohol, stearyl alcohol etc. In case of using a higher alcohol with carbon atoms less than 10, wind-up trouble could result due to higher friction between fiber and metal tending to lower passage ability of carding machine. On the other hand, in case of using higher alcohol with carbon atoms more than 12, anti-static behavior gets worse.

Polyoxyalkylene consists of oxyalkylene units having 2 to 4 carbon atoms such as oxyethylene, oxypropylene, oxybutylene etc. The repeating unit of oxyalkylene is preferably added by 2 to 10 mol % on the basis of hydroxy-fatty acid ester.

Such polyoxyalkylene can be composed of oxyethylene units only or can include other oxyalkylene units block-wise and/or random-wise.

An alkaline material to neutralize the free acid in the ester can be illustrated as an alkali metal such as K or Na, ammonia or amines. Among them, K- or Na-salt is preferable in the viewpoint of anti-staticity.

These anionic surface active agent (C) is properly used as to hold 20 to 60% by weight in the fiber treating agent. In case less than 20%, anti-staticity and cardability is getting worse. And in case more than 60%, durable hydrophilicity is lowered adversely.

Fiber treating agent applied to the durable hydrophilic fiber of this invention is preferably used at the before-said ratio of surfactant (A) to surfactant (B) of 20/80 to 80/20, more preferably of 30/70 to 70/30. (A) and (B)are mixed together within the each proper range above-mentioned. Mixture of (A) and (B) preferably holds over 40% by weight of total fiber treating agent. And depending on the nature of thermoplastic fiber to be used, any surfactant known to the art other than (A), (B) and (C) can be optionally added to the extent not to affect the aim of this invention. Addition level of this fiber treating agent to said thermoplastic fiber is from 0.2 to 1.5% by weight, preferably from 0.3 to 1.0% by weight. If less than 0.2% by weight, anti-staticity and durable hydrophilicity are insufficient. And if more than 1.5% by weight, winding-up trouble to the cylinder at the carding process is likely to take place or fabric tends to get sticky.

There is no limitation of process by which these fiber treating agents is added to the thermoplastic fiber. Any known process can be adopted such as contacting to the oiling roll at the spinning and/or drawing process; dipping in the soaking bath; or spraying. Or these process can be used after fabrication into the fabric.

The durable hydrophilic treating agent used in this invention is successfully used, mainly because of its viscosity depending on the concentration of the betaine ampho-ionic surface active agent (A). In the case of a dilute aqueous solution of 1 to 10% which durable hydrophilic treating agents are applied to fiber, viscosity of the aqueous solution is low so that application to fiber goes easily. Whilst once applied to the fiber surface and dried-up, the dried surface active agent keeps high viscosity when dipped in water again so that dissolves very little resulting in durable treating agent. Furthermore, the surface active agent (B) has relatively higher molecular weight, is dissolved little in water after once applied to the fiber surface, and can act effectively as durable hydrophilic agent.

On the performance of the fiber finishing agent, as an example, treatment under high pressure water stream is described for the case of dividable conjugated fiber. Usually in the case of radially dividable conjugated fiber composed of hydrophobic thermoplastic fibers, normal hydrophilic surface active agent applied to the fiber surface as fiber finishing agent is perfectly rinsed off by high pressure water stream in the course of water-jet non-woven process.

Because these fibers themselves are highly hydrophobic, fibers cannot absorb impinging energy of water sufficiently to form non-woven fabric as fibers are kept off from water stream at the initial stage of the process. Thus to get uniform ultra-fine splitting for non-woven cloth, multi-stage high pressure water streaming become necessary.

In the case of this invention, while a radially dividable fibers to which the fiber fishing agent used in this invention is applied on the fiber surface is composed of highly hydrophobic resins as usual, hydrophilicity can be maintained sufficiently as the fiber finishing agent of this invention can stay long time on the surface of the fiber. Namely even in the case of repeating high pressure water stream treatment, the fibers can receive uniform impinging energy of water requiring less stages of water treatment to become uniformly split ultra-fine non-wovon cloth.

Similarly durable hydrophilic fiber of this invention can be used for wet process such as paper making as the loss of finishing agent in water is very slow.

Thus the fiber's hydrophilicity or dispersability in water can be kept even hydrophobic thermoplastic polymer such as polyolefin is used as a raw material.

A fabric using the durable hydrophilic fiber of this invention can be any form of fabric such as woven textile, knitted textile, non-woven cloth or non-woven fiber aggregate. Also various mixed fibers made by cotton mixing, mix spinning, mix weaving, doubling and twisting, mixed knitting or union cloth can be formed into fabric through the above-mentioned process. A fabric obtained by this invention may be used alone or as laminated or integrated state with other non-woven fabric, knitted or woven fabric, mesh fabric, film or molded article.

Said fabric can be made by known method. For example, a nonwoven fabric is made using the following processes:

Step 1: Short fibers are piled up through dry or wet process into web.

Step 2: The web of step 1 is fixed by pressure on heated roll or through super-sonic wave, by partial melting through hot air or by fiber intermingling through high pressure water or needling.

Also knitted or woven fabric is made by knitting or weaving using spun or continuous fibers.

Achieving the aim of this invention can be performed also by applying the said fiber finishing agent onto any ready-made fabric obtained by spun-bond, melt-blown or flush spinning other than the fabric by before-mentioned processes. Among the durable hydrophilic fibers of this invention, conjugated fibers such as side-by-side, sheath and core, eccentric sheath and core, radially split or sea and island type can be cut into short fiber, mixed with water-absorbing material such as pulp or water-absorbable polymer, heat treated to afford stable forn for water absorber.

Water absorbing function of general thermoplastic conjugated fibers tend to be lower as the mixing ratio goes higher, but it is not the case for the durable hydrophilic fiber of this invention because its hydrophilicity is sustained.

The durable hydrophilic fiber and fabric using said fiber can be widely used for hygienic material in its surface sheet, second sheet or shape keeper for water absorber; wiping cloth for medical or industrial use; absorbing pad; reinforcing fiber in concrete for civil or construction; liquid transporting membrane; aqueduct or water permeable sheet.

EXAMPLES

The present invention is described in more detail by the following examples though this invention will not be restricted to these examples provided that the substance of this invention is not surpassed.

The following evaluation methods were adopted in each examples.

(1) Anti-staticity 40 g of sample fiber was formed into web using roller-card testing machine at the speed of 7 m/min and in the condition of 20° C. and 45% relative humidity. Electrostatic voltage generated in the web was measured and rated as follows:

○: less than 100 V

Δ: more than 100 V but less than 500 V

×: more than 500 V

Electrostatic voltage less than 100 V was rated as practically usable level.

(2) Cardability 40 g of sample fiber was formed into web using roller-card testing machine at the speed of 7 m/min in and in the condition of 30° C. and 80% relative humidity. After stopping the roller-card machine, observation of the cylinder roll was made and ranked as follows:

○: no wound up fiber was observed

Δ: partial fiber wind-up on the cylinder was observed

×: almost full range fiber wind-up on the cylinder was observed (3) Appearance of Web Obtained Appearance of web obtained by the same procedure as above was observed and ranked as follows:

○: no nep observed; uniform web with tension

Δ: nep observed locally

×: poor tension and uneven web (4) Durable Hydrophilicity of the Fabric

Fabric of 30 g /m2 weight was cut 10 cm by 10 cm and set on the commercial disposable diaper. A cylinder having inner-diameter of 6 cm was set on the sample and 65 ml of water was poured inside the cylinder so that water penetrated through the sample being absorbed in the diaper. 3 minutes after pouring, the wet fabric was sandwiched between two sheet of filter paper(Toyo Roshi No. 50). A weight and a plate of 10 cm by 10 cm which weigh 3.5 kg in total were placed. Left in this situation, the sample was dried. Then further open dried for another 5 minutes. Resulted sample was put on the filter paper(Toyo Roshi No.50). Water controlled at 23±2° C. in the constant temperature bath was dripped using a pipette drop by drop shifting position stepwise from the height of 1 cm above the sample up to 20 drops in total. Every drop was measured the time to disappear and the number of drops which disappear within 10 seconds was recorded. Tested sample was further put on the commercial diaper and the same test was repeated three times. Rating was made as the more number of disappeared drops, the better durable hydrophilicity.

(5) Hand Touch

A sensual test was performed to measure the hand touch of the samples hiring 10 monitor persons. These persons judged how the hand touch was for each samples. Result was made by the following standard:

○: At least 8 persons judged good without sticking touch

Δ: 3 to 7 persons judged good without sticking touch

×: 1 or 2 persons judged good without sticking touch

EXAMPLES 1–14, COMPARATIVE EXAMPLES 1–3

Thermoplastic resins of polypropylene (PP), high density polyethylene (HDPE) and polyethylene terephthalate (PET) were used to make fibers having cross section of uniform (mono-component) structure, sheath-core structure, side-by-side structure or radially dividable into 16 zones (splittable type) in which conjugated fiber two resins were used at the ratio 50:50 by volume. Finishing agents of various composition listed in Table 1 and 2 were applied onto the fiber and resulted fibers were formed into fabric by the following fabrication processes:

Fabrication process (a)

Spun-bonded non-woven cloth of 30 g/m$^2$ weight was made by heat treatment using embossing rolls (130° C., line pressure of 20 kg/cm, embossing area of 25%) and was treated with finishing agent of compositions shown in Table 1 and 2

Fabrication process (b)

Card web was made from fiber using roller-card testing machine and subsequently heat treated by suction-dryer (140° C.) into non-woven cloth of 30 g/m$^2$ weight.

Fabrication process (c)

Card web was made from fiber using roller-card testing machine and subsequently heat treated by embossing rolls (130° C., line pressure of 20 kg/cm, embossing area of 25%) into non-woven cloth of 30 g/m$^2$ weight.

Fabrication process (d)

40 counts of spun yarn was spun from fiber and was subsequently knit by circular knitting machine into knitting cloth.

Explanation of Table 1 & 2

"H-castor oil" means hydrogenated castor oil

"E0(30)" means adduct of polyethylene oxide having 30 units of ethylene oxide

"Ex." means an example

"Comp. Ex." means an comparative example

"(C18)alkyl" means alkyl having 18 carbon atoms (namely stearyl)

"S/C" means sheath/core structure

"S/S" means side-by-side structure

TABLE 1

| | | | Ex 1 | Ex 2 | Ex 3 | Ex 4 | Ex 5 | Ex 6 | Ex 7 | Ex 8 | Ex 9 |
|---|---|---|---|---|---|---|---|---|---|---|---|
| Composition of this invention | A | (C18) alkyl di-methyl betaine | 40 | 40 | 30 | 30 | 30 | 40 | | | 40 |
| | | (C12) alkyl di-methyl betaine | | | | | | | 30 | | |
| | | (C18) alkyl triglycine | | | | | | | | 40 | |
| | B | H-castor oil triglyceride EO (30) maleate | 40 | 40 | 30 | 30 | 30 | | | 30 | 40 |
| | | H-castor oil triglyceride EO (80) maleate | | | | | | 30 | | | |
| | | Castor oil triglyceride EO (30) succinate | | | | | | | 40 | | |
| | C | (C12) alkyl phosphate K salt | | 20 | 40 | 40 | 40 | 30 | | 30 | 20 |
| | | (C18) alkyl phosphate K salt EO (5) | | | | | | | 40 | | |
| Other composition | | Stearic acid di-ethanol amide | | | | | | | | | |
| | | Sorbitan mono oleate EO (20) | 20 | | | | | | | | |
| | | Polyether modified silicone (EO modified) | | | | | | | | | |
| Fiber | | Applied level (wt %) | 0.5 | 0.5 | 0.3 | 0.5 | 1.5 | 0.5 | 0.5 | 0.5 | 0.7 |
| | Resin | Fiber structure (cross section) | Uniform | S/C | S/C | S/C | S/C | S/C | S/S | Uniform | Split. |
| | | 1st component (core component) | PP | PP | PET | PP | PP | PET | PP | PP | PP |
| | | 2nd component (sheath component) | — | HDPE | HDPE | HDPE | HDPE | HDPE | HDPE | — | HDPE |
| | Cardability | Anti-staticity | — | ○ | ○ | ○ | ○ | ○ | ○ | ○ | ○ |
| | | Cardability | — | ○ | ○ | ○ | ○ | ○ | ○ | ○ | ○ |
| | | Web appearance | — | ○ | ○ | ○ | ○ | ○ | ○ | ○ | ○ |
| Fabric | | Fabric (fabrication process) | a | b | b | b | b | c | b | d | c |
| | Durable hydrophilicity (No./20) | 1st time | 18 | 20 | 20 | 20 | 20 | 20 | 20 | 20 | 19 |
| | | 2nd time | 17 | 20 | 18 | 20 | 20 | 19 | 18 | 19 | 17 |
| | | 3rd time | 16 | 19 | 15 | 19 | 20 | 16 | 15 | 18 | 15 |
| | Hand touch | | ○ | ○ | ○ | ○ | ○ | ○ | ○ | ○ | ○ |

TABLE 2

| | | | Ex 10 | Ex 11 | Ex 12 | Ex 13 | Ex 14 | Comp. Ex. 1 | Comp. Ex. 2 | Comp. Ex. 3 |
|---|---|---|---|---|---|---|---|---|---|---|
| Composition of this invention | A | (C18) alkyl di-methyl betaine | 25 | 50 | 10 | 20 | | 10 | | |
| | | (C12) alkyl di-methyl betaine | | | | | 60 | | 10 | |
| | | (C18) alkyl triglycine | | | 10 | | | | | |
| | B | H-castor oil triglyceride EO (30) maleate | 25 | 20 | 20 | 60 | | | | |
| | | H-castor oil triglyceride EO (80) maleate | | | 30 | | 20 | | | |
| | | Castor oil triglyceride EO (30) succinate | | | | | | 10 | 20 | |
| | C | (C12) alkyl phosphate K salt | | 30 | 30 | | 20 | 80 | | |
| | | (C18) alkyl phosphate K salt EO (5) | 30 | | | 20 | | | 30 | 20 |
| Other composition | | Stearic acid di-ethanol amide | 10 | | | | | | | 20 |
| | | Sorbitan mono oleate EO (20) | 10 | | | | | | | 20 |
| | | Polyether modified silicone (EO modified) | | | | | | | 40 | 40 |
| Fiber | | Applied level (wt %) | 0.5 | 0.5 | 0.5 | 0.5 | 0.5 | 0.5 | 0.5 | 0.5 |
| | Resin | Fiber structure (cross section) | S/C | S/C | S/C | S/C | S/C | S/C | S/C | S/C |
| | | 1st component (core component) | PP | PP | PP | PP | PP | PP | PP | PP |
| | | 2nd component (sheath component) | HDPE | HDPE | HDPE | HDPE | HDPE | HDPE | HDPE | HDPE |
| | Cardability | Anti-staticity | ○ | ○ | ○ | ○ | ○ | ○ | Δ | Δ |
| | | Cardability | ○ | ○ | ○ | ○ | Δ | ○ | Δ | Δ |
| | | Web appearance | ○ | ○ | ○ | ○ | ○ | ○ | Δ | Δ |
| Fabric | | Fabric (fabrication process) | b | b | b | b | b | b | b | b |
| | Durable hydrophilicity (No./20) | 1st time | 19 | 20 | 20 | 20 | 19 | 19 | 19 | 19 |
| | | 2nd time | 17 | 18 | 18 | 19 | 16 | 10 | 17 | 16 |
| | | 3rd time | 15 | 16 | 15 | 17 | 14 | 5 | 13 | 14 |
| | Hand touch | | ○ | ○ | ○ | ○ | ○ | ○ | ○ | ○ |

THE EFFECT OF THIS INVENTION

The durable hydrophilic fibers of this invention and the fabric using said fiber are superior in durable hydrophilicity and can prevent the slippage between fibers thus keep the strength of fiber web such as non-woven fabric. Furthermore as the products have no sticky touch, absorbability of body fluid can last for long hours with good touch to skin when used for the surface sheet or second sheet of disposable diaper or sanitary napkin in the hygienic materials.

What is claimed is:

1. A durable hydrophilic fiber comprising a fiber consisting of a thermoplastic resin to which 0.2–1.5% by weight of fiber-treating agent based on the fiber is applied wherein the fiber-treating agent contains at least 40% by weight of a mixture comprising of 20–80% by weight of the following component (A) and 80–20% by weight of the following component (B);

wherein component (A) is a betaine compound represented by formula (1)

$$R^1R^2R^3—N^+—CH_2COO^- \quad (1)$$

($R^1$ represents an alkyl group having 8–30 carbon atoms or such an alkyl group wherein its hydrogen atom is replaced by a hydroxyl- or a carboxyl-group; $R^2$ and $R^3$ each represents independently a hydrogen, an alkyl group having 1–5 carbon atoms or such an alkyl group wherein its hydrogen atom is replaced by a hydroxyl- or a carboxyl-group);

and component (B) is an ester compound of a dicarboxylic acid having 2–20 carbon atoms, and an ester of hydroxy-fatty acid having 5–30 carbon atoms which 10 to 100 mol % (on the basis of the number of hydroxyl groups existing in the molecule of said hydroxy-fatty acid ester) of oxyalkylene units are added to its hydroxyl group.

2. The durable hydrophilic fiber according to claim 1, wherein the fiber-treating agent contains at least 80% by weight of mixture consisting of 20 to 50% by weight of said component (A), 20 to 50% by weight of said component (B) and, additionally 20 to 60% by weight of an anionic surface active agent (C).

3. The durable hydrophilic fiber according to claim 1, wherein said component (A) is an alkyl dimethylbetaine compound in which $R^1$ is an alkyl group having 8–20 carbon atoms, and $R^2$ and $R^3$ are both methyl group.

4. The durable hydrophilic fiber according to claim 1, wherein the hydroxy-fatty acid ester having 5–30 carbon atoms which 10 to 100 mol % (on the basis of the number of hydroxyl groups existing in the molecule of said hydroxy-fatty acid ester) of polyoxyalkylene units are added to its hydroxyl group in the component (B) is a hardened castor oil polyoxyethylene adduct.

5. The durable hydrophilic fiber according to claim 1, wherein the component (B) is a maleic acid ester of a hardened castor oil polyoxyethylene adduct.

6. The durable hydrophilic fiber according to claim 1, wherein at least one component of the thermoplastic resin is polyolefin resin.

7. The durable hydrophilic fiber according to claim 1, wherein at least one component of the thermoplastic resin is polyester resin.

8. A fabric made of the durable hydrophilic fiber described in claim 1.

* * * * *